US006024648A

United States Patent [19]

Shurtleff et al.

[11] Patent Number: 6,024,648

[45] Date of Patent: Feb. 15, 2000

[54] AUTOMATIC SWING WITH RECIPROCATING WEIGHT

[76] Inventors: Richard D. Shurtleff; Tina M. Shurtleff, both of 5286 Garrison Cir., San Jose, Calif. 95123

[21] Appl. No.: 09/182,738

[22] Filed: Oct. 29, 1998

[51] Int. Cl.[7] ..... A63G 9/16

[52] U.S. Cl. ..... 472/119; 297/260.2

[58] Field of Search ..... 472/119–125; 297/260.2, 273, 281; 5/108, 109

[56] References Cited

U.S. PATENT DOCUMENTS

| | | | |
|---|---|---|---|
| 3,821,822 | 7/1974 | Borreggine | 5/109 |
| 5,398,353 | 3/1995 | Sachathamakul | 5/109 |

*Primary Examiner*—Kien T. Nguyen

[57] ABSTRACT

A swing with automatic swinging feature is provided including a swing assembly having a seat unit and interconnects connected between the seat unit and an overhang support. Also included is an automatic swinging module mounted on the seat unit. The module includes a weight adapted to move in a reciprocating manner for effecting the swinging of the swing assembly.

6 Claims, 3 Drawing Sheets

AUTOMATIC SWING WITH RECIPROCATING WEIGHT

BACKGROUND OF THE INVENTION

1. Field of the Invention

The present invention relates to automatic swings and more particularly pertains to a new automatic swing with reciprocating weight for automatically swinging a swing assembly with a reciprocating weight.

2. Description of the Prior Art

The use of automatic swings is known in the prior art. More specifically, automatic swings heretofore devised and utilized are known to consist basically of familiar, expected and obvious structural configurations, notwithstanding the myriad of designs encompassed by the crowded prior art which have been developed for the fulfillment of countless objectives and requirements.

Known prior art automatic swings include U.S. Pat. No. 4,150,820; U.S. Pat. No. 2,807,309; U.S. Pat. No. 4,448,410; U.S. Pat. No. 3,420,523; U.S. Pat. No. 4,323,233; and International Patents EP 0 286 321 A2 and WO 85/05559.

In these respects, the automatic swing with reciprocating weight according to the present invention substantially departs from the conventional concepts and designs of the prior art, and in so doing provides an apparatus primarily developed for the purpose of automatically swinging a swing assembly with a reciprocating weight.

SUMMARY OF THE INVENTION

In view of the foregoing disadvantages inherent in the known types of automatic swings now present in the prior art, the present invention provides a new automatic swing with reciprocating weight construction wherein the same can be utilized for automatically swinging a swing assembly with a reciprocating weight.

The general purpose of the present invention, which will be described subsequently in greater detail, is to provide a new automatic swing with reciprocating weight apparatus and method which has many of the advantages of the automatic swings mentioned heretofore and many novel features that result in a new automatic swing with reciprocating weight which is not anticipated, rendered obvious, suggested, or even implied by any of the prior art automatic swings, either alone or in any combination thereof.

To attain this, the present invention generally comprises a mounting assembly having a pair of inverted L-shaped brackets. Each of such brackets includes a short horizontal extent with a pair of bores formed therein. The bores of the brackets are adapted for receiving ends of an inverted U-shaped bolt which is fixedly coupled to a horizontally oriented support bar. The pair of L-shaped brackets further have elongated vertical extents depending from the short horizontal extents. A pivot post is coupled between the elongated vertical extents with ends extending therefrom. Next provided is a swing assembly including a seat unit. As best shown in FIG. 5, the seat unit includes a bottom face and a thickened rear face with a lower edge coupled to a rear edge of the bottom face and extending upwardly therefrom. A pair of planar L-shaped side lips are coupled to side edges of the bottom face and rear face of the seat unit and extend upwardly and forwardly therefrom, respectively. With reference still to FIG. 5, the swing assembly further includes a retainer having a T-shaped configuration. A bottom of a vertical portion of the retainer is centrally coupled to a front edge of the bottom face of the seat unit and extends upwardly therefrom. A pair of horizontal portions extend laterally from a top end of the vertical portion of the retainer and abut the side lips. Finally, a pair of rigid, linear upstanding members each have a lower end coupled to a top edge of the rear face of the seat unit and extend upwardly therefrom in parallel relationship. In use, the upstanding members are adapted for coupling with ends of the pivot post of the mounting assembly. Mounted on a lower surface of the bottom face of the seat unit of the swing assembly is an automatic swinging module. Such module includes a housing with a pair of geared racks mounted along side edges of a bottom thereof. A platform is also provided with a motor mounted thereon. A rotor of the motor extends from sides of the platform with pinions fixedly coupled thereto. As shown in FIG. 3, these pinions are adapted for engaging the geared racks and moving thereon between a front and rear of the swing assembly. In the preferred embodiment, a 10 lb. weight fixed to the platform. Finally, a limit switch is mounted on the platform. In use, the limit switch is adapted for effecting movement of the platform in an opposite direction upon the depression thereof. It should be noted that such movement of the platform only takes place when the motor is supplied with power via a rechargeable battery, as dictated by a switch positioned on a rear face of the module. Ideally, a solar cell is situated on a back surface of the rear face of the seat unit of the swing assembly. As shown in FIG. 4, the solar cell is connected to the battery for recharging the same upon being exposed with light.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic swing with reciprocating weight apparatus and method which has many of the advantages of the automatic swings mentioned heretofore and many novel features that result in a new automatic swing with reciprocating weight which is not anticipated, rendered obvious, suggested, or even implied by any of the prior art automatic swings, either alone or in any combination thereof.

It is another object of the present invention to provide a new automatic swing with reciprocating weight which may be easily and efficiently manufactured and marketed.

It is a further object of the present invention to provide a new automatic swing with reciprocating weight which is of a durable and reliable construction.

An even further object of the present invention is to provide a new automatic swing with reciprocating weight which is susceptible of a low cost of manufacture with regard to both materials and labor, and which accordingly is then susceptible of low prices of sale to the consuming public, thereby making such automatic swing with reciprocating weight economically available to the buying public.

Still yet another object of the present invention is to provide a new automatic swing with reciprocating weight which provides in the apparatuses and methods of the prior art some of the advantages thereof, while simultaneously overcoming some of the disadvantages normally associated therewith.

Still another object of the present invention is to provide a new automatic swing with reciprocating weight for automatically swinging a swing assembly with a reciprocating weight.

Even still another object of the present invention is to provide a new automatic swing with reciprocating weight that includes a swing assembly having a seat unit and interconnects connected between the seat unit and an overhang support. Also included is an automatic swinging module mounted on the seat unit. The module includes a weight adapted to move in a reciprocating manner for effecting the swinging of the swing assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
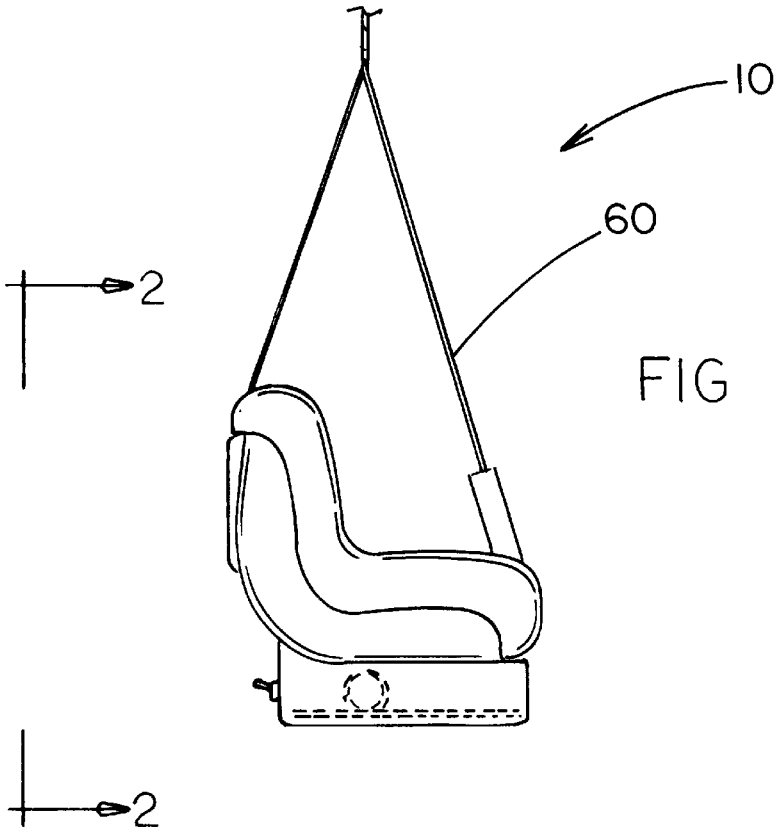
FIG. 1 is a side view of one of the embodiments of the present invention.

With reference now to the drawings, and in particular to FIGS. 1 through 5 thereof, a new automatic swing with reciprocating weight embodying the principles and concepts of the present invention and generally designated by the reference numeral 10 will be described.

Figure 2:
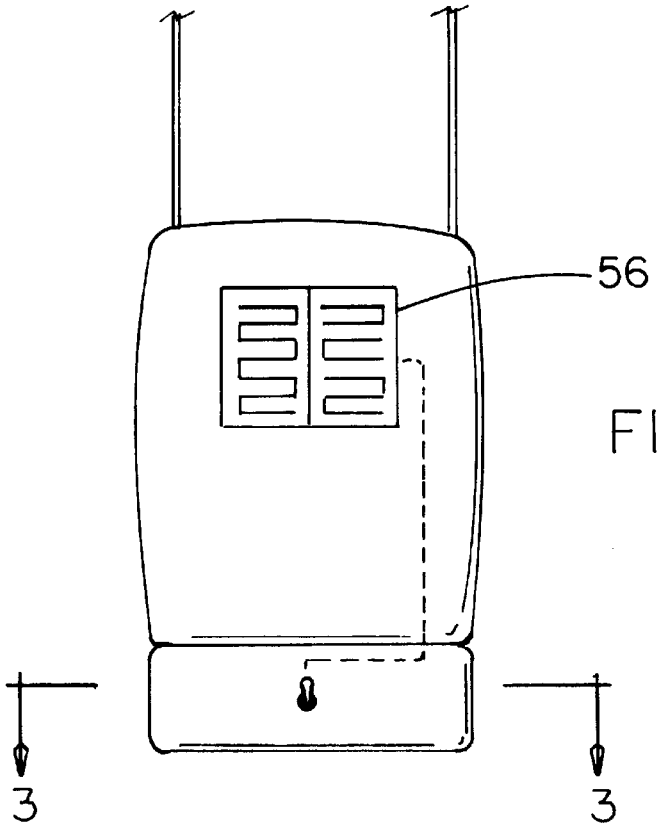
FIG. 2 is a rear view of the embodiment of the present invention shown in FIG. 1.
Figure 3:
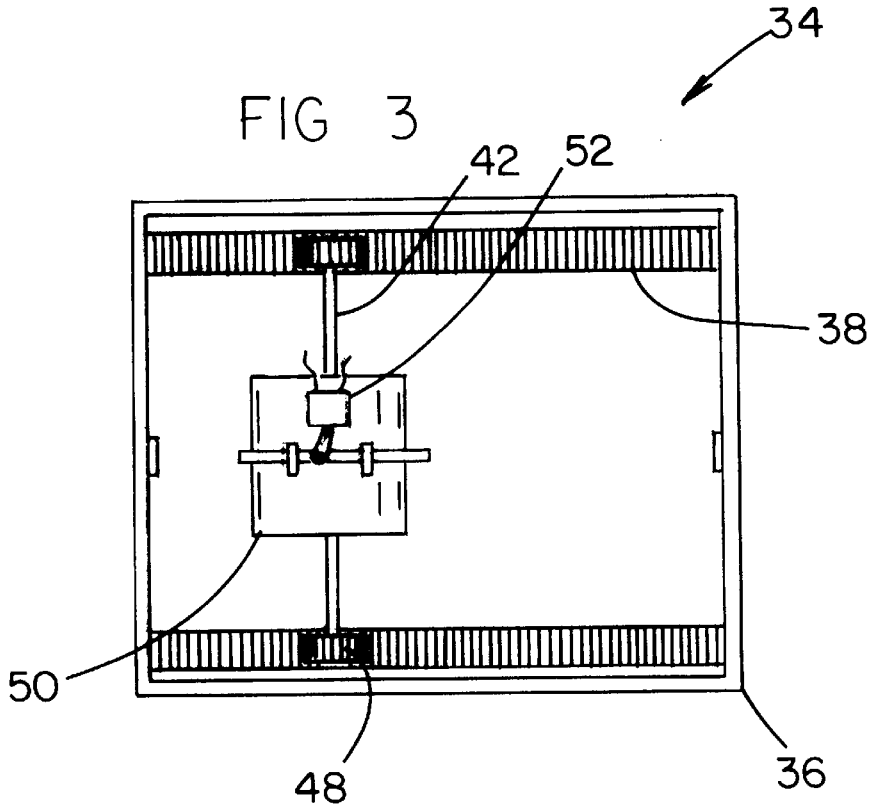
FIG. 3 is a top cross-sectional view of the present invention taken along line 3—3 shown in FIG. 2.
Figure 5:
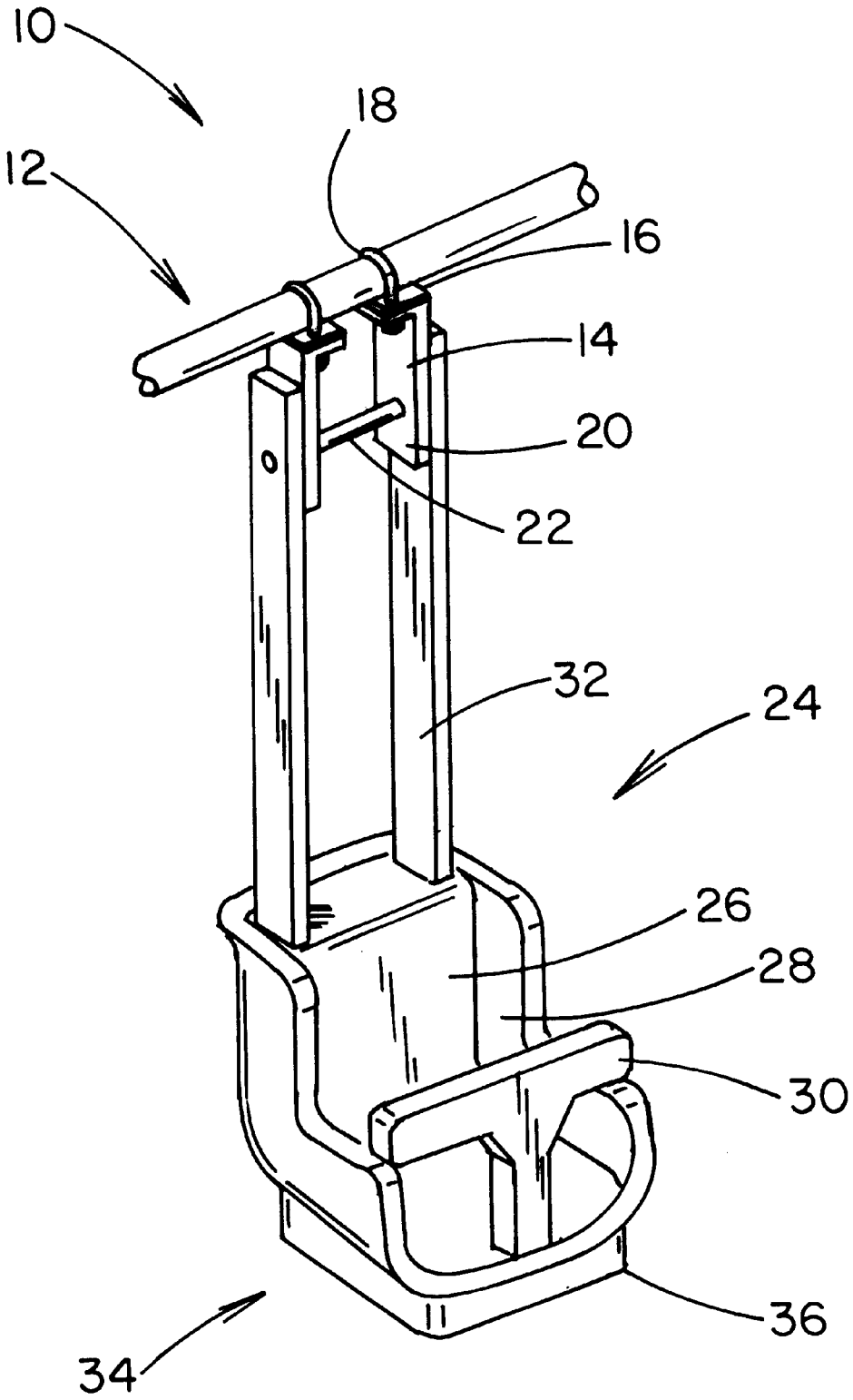
FIG. 5 is a perspective view of another embodiment of the present invention.

The present invention, designated as numeral 10, includes two embodiments the first of which is depicted in FIGS. 1–3 and the second of which is set forth in FIG. 5. The second embodiment of FIG. 5 will first be set forth.

The embodiment of FIG. 5 includes a mounting assembly 12 having a pair of inverted L-shaped brackets 14. Each of such brackets includes a short horizontal extent 16 with a pair of bores formed therein. The bores of the brackets are adapted for receiving ends of an inverted U-shaped bolt 18 which is fixedly coupled to a horizontally oriented support bar, branch or the like. The pair of inverted L-shaped brackets further have elongated vertical extents 20 depending from the short horizontal extents. A pivot post 22 is coupled between the elongated vertical extents with ends extending therefrom.

Next provided is a swing assembly 24 constructed from molded plastic and including a seat unit 26. As best shown in FIG. 5, the seat unit includes a bottom face and a thickened rear face with a lower edge coupled to a rear edge of the bottom face and extending upwardly therefrom. A pair of planar L-shaped side planar lips 28 are coupled to side edges of the bottom face and rear face of the seat unit and extend upwardly and forwardly therefrom, respectively.

With reference still to FIG. 5, the swing assembly further includes a retainer 30 having a T-shaped configuration. A bottom of a vertical portion of the retainer is centrally coupled to a front edge of the bottom face of the seat unit and extends upwardly therefrom. A pair of horizontal portions extend laterally from a top end of the vertical portion of the retainer and abut the side lips. Finally, a pair of rigid, linear upstanding members 32 each have a lower end coupled to a top edge of the rear face of the seat unit and extend upwardly therefrom in parallel relationship. In use, the upstanding members are adapted for pivotally coupling with the ends of the pivot post of the mounting assembly. As an option, the swing assembly may be equipped with two seat units for seating two children.

Mounted on a lower surface of the bottom face of the seat unit of the swing assembly is an automatic swinging module 34. Such module includes a housing 36 with a pair of geared racks 38 mounted along side edges of a bottom thereof. A platform is also provided with a motor 40 mounted thereon. A rotor 42 of the motor extends from sides of the platform with pinions 48 fixedly coupled thereto. As shown in FIG. 3, these pinions are adapted for engaging the geared racks and moving the platform within the housing between a front and rear of the swing assembly. In the preferred embodiment, a 10 lb. weight 50 is fixed to the platform.

Finally, a limit switch 52 is mounted on platform. In use, the limit switch is adapted for effecting movement of the platform in an opposite direction upon the depression thereof. To accomplish this, the limit switch preferably includes a double-pole double-throw switch having an end connected to a post which reciprocates upon being pressed against either a front or rear of the module. Note FIGS. 3 & 4. As an option, a pair of limit switches may be mounted on the front and rear of the module for accomplishing similar results.

Figure 4:
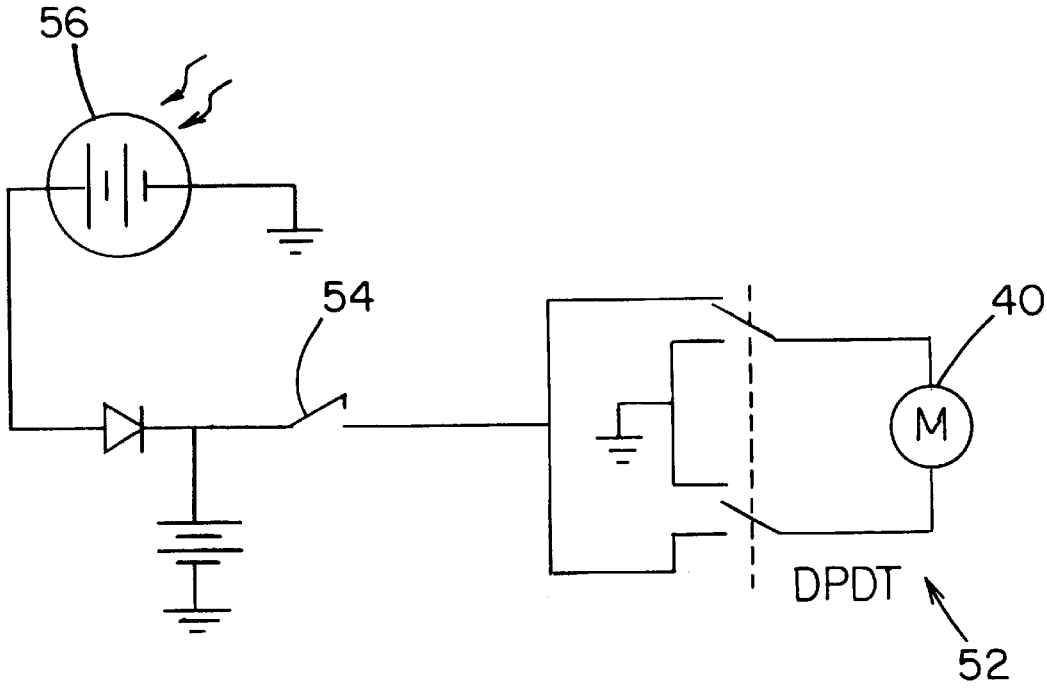
FIG. 4 is a schematic diagram of the present invention.

It should be noted that such movement of the platform only takes place when the motor is supplied with power via a rechargeable battery, as dictated by a toggle switch 54 positioned on a rear or side face of the module. Ideally, a solar cell 56 is situated on a back surface of the seat unit of the swing assembly. As shown in FIG. 4, the solar cell is connected to the battery for recharging the same upon being exposed with light.

In another embodiment shown in FIGS. 1–2, the upstanding members are replaced with strings 60 as another means of interconnecting the swing assembly to a support such as a tree, pole or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A swing with automatic swinging feature comprising, in combination:

a mounting assembly including a pair of inverted L-shaped brackets each having a short horizontal extent with a pair of bores formed therein for receiving ends of an inverted U-shaped bolt which is fixedly coupled to a horizontally oriented support bar, the pair of L-shaped brackets further having elongated vertical extents depending from the short horizontal extents with a pivot post coupled therebetween with ends extending therefrom;

a swing assembly including a seat unit having a bottom face and a thickened rear face with a lower edge coupled to a rear edge of the bottom face and extending upwardly therefrom, a pair of planar L-shaped side lips coupled to side edges of the bottom face and rear face of the seat unit and extending upwardly and forwardly therefrom, respectively, a retainer having a T-shaped configuration with a bottom of a vertical portion thereof being centrally coupled to a front edge of the bottom face of the seat unit and extending upwardly therefrom with a pair of laterally extending horizontal portions which abut the side lips, and a pair of rigid, linear upstanding members each having a lower end coupled to a top edge of the rear face of the seat unit and extending upwardly therefrom in parallel relationship for coupling with ends of the pivot post of the mounting assembly; and an automatic swinging module including a housing mounted on a lower surface of the bottom face of the seat unit of the swing assembly, a pair of geared racks mounted along side edges of a bottom of the module, a platform with a motor mounted thereon with a rotor extending therefrom with pinions fixedly coupled thereto for engaging the geared racks and moving thereon between a front and rear of the swing assembly, a 10 lb. Weight fixed to the platform, and a limit switch mounted on a front and a rear of the housing of the module for effecting movement of the platform in an opposite direction upon the depression thereof when the motor is supplied with power via a rechargeable battery, wherein a solar cell is mounted on a back surface of the rear face of the seat unit of the swing assembly and connected to the battery for recharging the same upon being exposed with light.

2. A swing with automatic swinging feature comprising:

a swing assembly having a seat unit; and and a swinging module mounted on the seat unit, the swinging module having a housing having an interior space;

a pair of gear tracks positioned in the interior space of the housing in substantially parallel spaced relationship with respect to each other, said gear tracks being fixedly coupled relative to said housing, said gear tracks being further aligned parallel with a line of movement of said swing assembly;

a motor coupled to a platform positioned between the gear tracks, the motor having rotors extending outwardly from opposite sides of the motor, each rotor having a pinion for engaging an associated one of said gear tracks such that turning of said rotors moves said platform relative to said gear tracks substantially along said line of movement of said swing assembly for urging said swing assembly into a swinging motion when said platform is moved back and forth along said gear tracks by said motor.

3. The swing with automatic swinging feature as set forth in claim 2 wherein the module is situated on a lower surface of a bottom face of the seat unit.

4. The swing as set forth in claim 2, further comprising:

a weight coupled to said platform for facilitating urging of said swing assembly into the swinging motion when said platform is moved by said motor.

5. The swing as set forth in claim 2, further comprising:

a pair of limiting switches, each limiting switch being coupled to the housing on opposite sides of the motor such that the platform travels along the gear tracks between the limiting switches, each respective limiting switch being operationally coupled to the motor for reversing a direction of movement of the platform along the gear tracks upon depression of the respective limiting switch.

6. An automatic swing comprising:

a mounting assembly including a pair of brackets, each bracket having a first extent having a pair of bores formed therein for receiving ends of an inverted generally U-shaped bolt, said bolt being fixedly coupled to a support bar, the pair of brackets further having second extents depending from the first extents;

a pivot post having opposite ends, said pivot post being coupled to said brackets such that said pivot post extends between the brackets and each opposite end extends outwardly from an associated one of said brackets;

a swing assembly including a seat unit having a bottom face and a rear face, said rear face having a lower edge coupled to a rear edge of the bottom face, said rear face extending upwardly from said bottom face;

a pair of side lips coupled to side edges of the bottom face and rear face of the seat unit, said side lips extending upwardly from the bottom face and forwardly from the rear face;

a retainer having a first portion and a second portion, a bottom of said first portion being coupled to a front edge of the bottom face of the seat unit, said first portion extending upwardly from the front edge of the bottom face, an end of said first portion being coupled to a middle said second portion such that said second portion extends outwardly from said end of said first portion to abut the side lips;

a pair of upstanding members, a lower end of each upstanding member being coupled to a top edge of the rear face of the seat unit and extending upwardly from the top edge in parallel relationship with respect to each other, said upstanding members being for coupling with said opposite ends of the pivot post of the mounting assembly;

an automatic swinging module including a housing mounted on a lower surface of the bottom face of the seat unit of the swing assembly, said swinging module including a pair of geared racks mounted along side edges of a bottom of the module, said swinging module including a platform, a motor being mounted on the platform, a rotor extending from the motor, the rotor having pinions for engaging the geared racks for moving the pinions on the gear racks between a front and rear of the swing assembly;

a weight fixed to the platform;

a limit switch being mounted on a front and a rear of the housing of the module, each limit switch being for reversing a direction of movement of the platform along the gear tracks upon the depression of the respective limit switch;

the motor being operationally coupled to a battery for providing power to the motor; and a solar cell mounted on a back of the rear face of the seat unit, the solar cell being operationally connected to the battery for recharging the battery.

* * * * *